United States Patent [19]

Hara et al.

[11] 4,357,887

[45] Nov. 9, 1982

[54] LOOP CATCHING DEVICE FOR LOCK STITCHING SEWING MACHINES

[75] Inventors: Kazumasa Hara, Tama; Mikio Koike, Oume, both of Japan

[73] Assignee: Janome Sewing Machine Co. Ltd., Japan

[21] Appl. No.: 164,028

[22] Filed: Jun. 30, 1980

[30] Foreign Application Priority Data

Jul. 4, 1979 [JP] Japan ..... 54-83956

[51] Int. Cl.[3] ..... D05B 3/02

[52] U.S. Cl. ..... 112/158 E; 112/199

[58] Field of Search ..... 112/158 E, 158 R, 158 A, 112/158 D, 181, 184, 197, 199

[56] References Cited

U.S. PATENT DOCUMENTS 2,652,795 9/1953 Casas-Robert et al. ..... 112/158 R 2,662,495 12/1953 Parry ..... 112/158 R

*Primary Examiner*—Peter P. Nerbun

*Attorney, Agent, or Firm*—Michael J. Striker

[57] ABSTRACT

A loop catching device for a sewing machine includes a rotatable loop taker carrying a lower thread, a pulse motor operated in a timed relationship with a reciprocating movement of a needle, and a looper arranged adjacently to the loop taker and driven by the motor. The loop taker and the looper are synchronized with the movement of the needle to catch the loop produced by the needle and hold the loop for a predetermined time.

3 Claims, 11 Drawing Figures

LOOP CATCHING DEVICE FOR LOCK STITCHING SEWING MACHINES

BACKGROUND OF THE INVENTION

The invention relates to a sewing machine and more particularly relates to a loop catching device for a sewing machine, which is to improve a loop taking condition of the loop taker. For attaining this object, the invention comprises substantially an electromagnetic element operated by pattern control data stored in a memory in synchronism with the vertical movement of the needle, and a loop catching member having a looper operated by the electromagnetic element in synchronism with the movement of the needle to catch the upper thread loop and hold the same for a predetermined time until the loop is taken by the hook of the loop taker.

In a zigzag sewing machine, it is generally known that the crossing conditions of the vertically reciprocating needle and the rotating hook of the loop taker are different at the needle dropping positions, for example, between the most rightward position and the most leftward position of the permissible needle swinging range. It is also known that the loop is often skipped by the hook of the looptaker at one of the two needle positions because the crossing condition of the needle and the hook is unsuited at that needle portion.

So far, various countermeasures have been provided to eliminate such a loop skipping phenomenon. For example, a method is known how to mechanically synchronize the movements of the needle and the loop taker at each crossing point. Another known method teaches how to electrically drive the loop taker in synchronism with the movement of the needle. Such methods, however, have been found unsatisfactory because they fail to prevent the skip of a loop by the loop taker. Especially the latter method requires a comparatively much power, and accordingly a device of large size will result which is difficult to be installed in a limited space of the sewing machine housing.

SUMMARY OF THE INVENTION

The present invention overcomes the defects and disadvantages of the prior art.

It is a primary object of the invention to provide a loop catching device which is operated in synchronism with the movement of the needle to catch the loop and hold the same for a predetermined time until the loop taker takes the loop.

It is another object of the invention to provide a loop catching device which is simple in structure and effective in operation to enable the loop taker to take the upper thread loop without failure.

The other features and advantages of the invention will be apparent from the following description of the preferred embodiment in reference to the attached drawings.

DESCRIPTION OF THE PREFERRED EMBODIMENT

Figure 1:
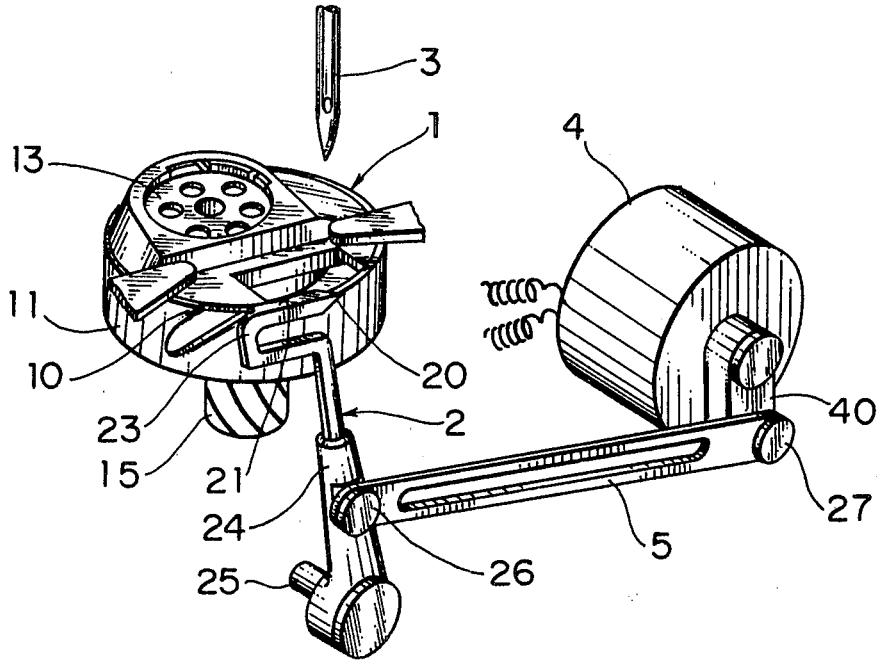
FIG. 1 is a perspective view of a main part of the loop takes according to the invention.
Figure 2:
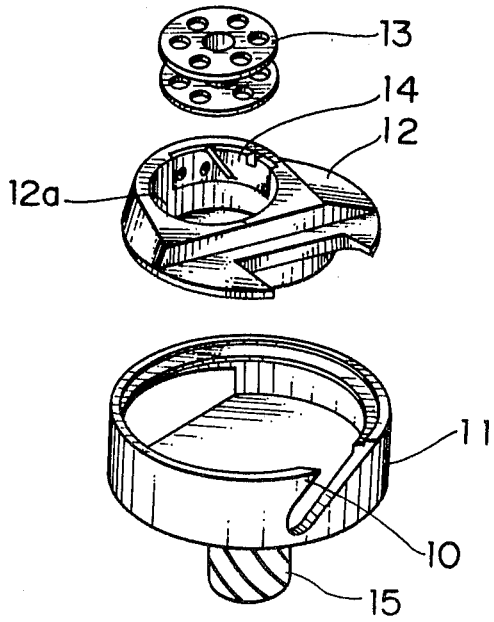
FIG. 2 is a perspective view of the elements composing a loop taker device of a sewing machine.

FIGS. 1 and 2 show a loop taking device of a sewing machine, which is rotated in a horizontal plane. The loop taking device 1 consists of an outer cup shaped looptaker 11 formed with a loop taking hook 10, a bobbin carrier 12 formed with a circular recess 12A, which is provided with a lower thread tension adjusting element 14, and positioned in the cup shaped loop taker 11. A lower thread winding bobbin 13 is carried in the circular recess 12A of the bobbin carrier 12. The lower thread (not shown) is drawn out from the bobbin 13 into passed upwardly through the thread tension adjusting element 14 of the bobbin carrier 12. As shown the loop taker 11 is provided at the bottom thereof with a gear 15 which is operatively connected to a driving mechanism (not shown), so that the loop taker 11 may be rotated in the counterclockwise direction in a timed relation with a vertically reciprocated needle 3.

As shown in FIG. 1, adjacently to the loop taker 11, a loop catching member 2 is provided. The upper end of the loop catching member 2 is provided with a looper 23. The looper 23 is laterally extended at the uppermost part 21 thereof. The part 21 is pointed at the free end 20 thereof as shown in FIG. 1. The loop catching member 2 has a vertical shank 24 which is at the lower end 25 turnably mounted to the housing of a sewing machine (not shown). A transmission rod 5 is at one end thereof connected to the intermediate part of the shank 24 of the loop catching member 2 by means of a pin 26, and is at the other end thereof connected, by a pin 27, to a crank arm 40 of a pulse motor 4, which is electrically connected to a memory for storing pattern control data progressively read out per rotation of the main shaft to control the lateral swinging movement of the needle. Thus the pulse motor 4 is driven in a timed relation with the needle 3, thereby to swingingly reciprocate the loop catching member 2 in a timed relation with the needle 3.

Figure 3:
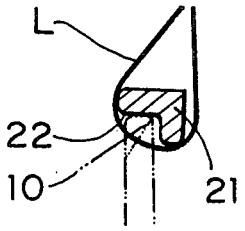
FIG. 3 is a vertical section of a looper and a loop taker shown in relation to a loop.

As shown in FIG. 3, the laterally extended part 21 of looper 23 is recessed at an angle against the upper periphery of the cup shaped loop taker 11, so that the hook 10 of the loop taker 11 may pass through the inside 22 of the angled part 21. Thus the pointed end 20 of the looper 2 is swingingly moved in synchronism with the vertical reciprocating movement of the needle 3, to catch the upper thread loop (L) which is formed as the needle 3 is going up after it has come to the lower dead point thereof and hold the loop in an enlarged condition. Then the hook 10 of the loop taker 11 takes the enlarged loop (L) by passing through the angled inner side 22 of the looper 23.

Operation of the invention is as follows:

In FIG. 4(A), the needle 3 with an upper thread $S_1$ is going down after it has formed up a preceding stitch, and comes down, in FIG. 4(B) through the needle hole 6 of the needle plate, to the lower dead point thereof in front of the loop taker 11. Then the needle 3 is going up in FIG. 4(C) and provides a loop (L) which is formed by the friction between the upper thread $S_1$ and the sewn fabric (not shown). As the loop catching member 2 is swingingly moved by the pulse motor 4 which is driven by a pattern data memory unit (not shown) in synchronism with the vertical reciprocating movement of the needle 3 and in the neighborhood of the needle dropping point under the needle plate, the laterally extended looper 2 with the pointed end 20 is inserted into the loop (L) which has become largest at the side of the needle 3. In FIG. 4(D), the pointed free end 20 of the looper 2 has been completely inserted into the loop and holds the loop in the enlarged condition. Then the loop taker 11 with the hook 10, which is rotated in synchronism with the vertical reciprocating movement of the needle 3 by the drive shaft (not shown) of the sewing machine, follows after the looper 2 and the hook 10 is inserted into the loop (L) through the passage defined by the angled looper 2 as shown in FIG. 4(E). In FIG. 4(F), the loop taker 11 is further rotated to enlarge the loop (L) therearound, and the needle 3 is going up and bringing up the thread $S_1$. In FIG. 4(G), the loop (L) of upper thread $S_1$ is taken off the loop taker 11 after it has made a complete rotation around the bobbin carrier 12, and simultaneously the looper 2 swings back in the leftward direction. Thus the upper thread $S_1$ locks the lower thread $S_2$ which is wound around the bobbin 13. In FIG. 4(H), the upper thread $S_1$ is pulled up by the thread take-up lever (not shown) and is further tightened to provide a seam in the fabric as shown. Then the needle 3 is going down again. As the loop taker 11 is of the type to catch the loop once in two rotation, the loop taker 11 with the hook 10 makes one complete rotation without catching the loop as is understood from FIG. 4(H), and catches the loop again in FIG. 4(D), through the steps in FIGS. 4(A)-(C), when the loop (L) is formed up as the needle 3 is going up after it has come to the lower dead point thereof.

Figure 4:
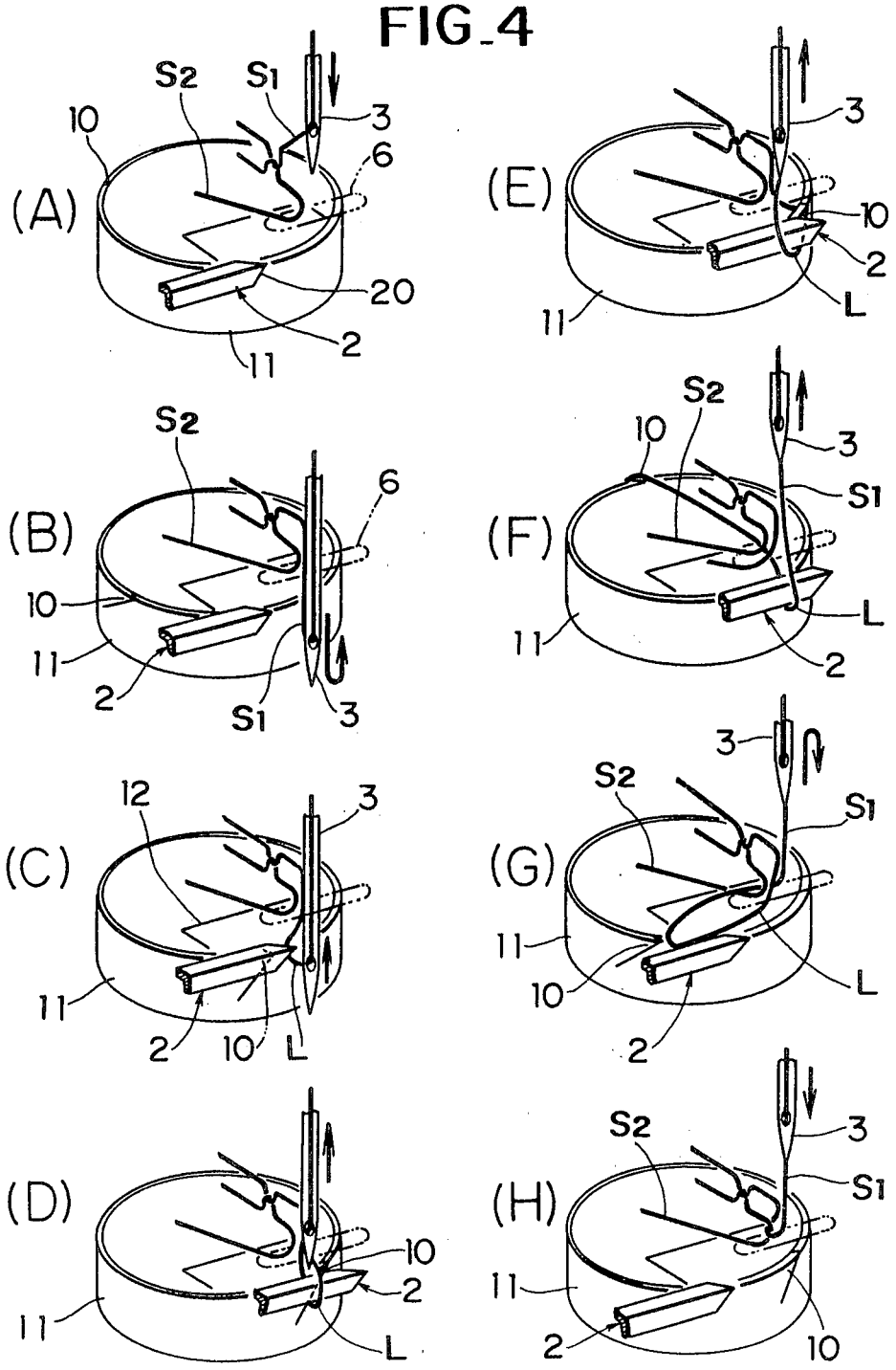
FIG. 4 shows a sequence of operations according to the invention.

According to the invention, as the pulse motor 4 is driven in synchronism with the movement of the needle 3 which is controlled by the control data stored in a memory, the looper 2 is swingingly operated in synchronism with the vertical movement of the needle 3 at the position where the needle comes down if the needle swingingly moved for producing a specific pattern. Thus the looper 2 provides a most suitable loop, in any types of stitches, to be caught by the hook 10 of the loop taker 11. FIG. 4 shows a straight stitching with a needle position located at the center of the basic needle positions, namely the right, center and left positions. According to the invention, if the needle 3 is swingingly moved and is dropped into the right and left positions alternately for zigzag stitching where the crossing conditions are different between the hook 10 and the needle 3, the looper 2 is swingingly operated in synchronism with the vertical reciprocating movement of the needle at the position where the needle is dropped. Thus the loop can be caught by the hook 10 without fail, if the needle 10 drops at any positions in the needle dropping range with respect to the loop taker 11.

According to this embodiment, the loop taker device 1 is arranged rearwardly of the needle 3. It would, however, be apparent that the present invention can be applied, without changing the gist of the invention, to the loop taker device 1 arranged forwardly of the needle 3, and to the different loop taker devices including the one of vertical type.

What is claimed as new and desired to be protected by Letters Patent is set forth in the appended claims:

1. A loop catching device for a sewing machine having a machine frame, a main shaft rotatably mounted on the machine housing, a needle swingable laterally of the feeding direction and operatively connected to the main shaft and vertically reciprocated by rotation of the main shaft to penetrate a fabric to be sewn, said needle carrying an upper thread to provide a loop formed while the needle point is located below the fabric, comprising a loop taker carrying a lower thread and rotated in a timed relation with the vertical reciprocating movement of the needle to catch the loop provided by the needle, needle control means for swinging the needle laterally of the feeding direction; an electromagnetic pulse motor operated in a timed relation with the movement of the needle in accordance to a selected pattern; and looper means provided adjacently to the loop taker and reciprocatingly operated by the pulse motor in a time relation with the movement of the needle to catch the loop and hold the same for a predetermined time.

2. A loop catching device as defined in claim 1, wherein said looper means comprises a looper element to be inserted into the loop, and a vertical shank which is at the lower end thereof turnably mounted to the machine housing.

3. A loop catching device as defined in claim 2, wherein said looper element is pointed at the free end thereof and is axially aligned against the loop taker providing a passage through which the hook of the loop taker is rotated.

* * * * *